US006453483B1

(12) United States Patent
Jacuzzi et al.

(10) Patent No.: US 6,453,483 B1
(45) Date of Patent: Sep. 24, 2002

(54) SPA WEIR SYSTEM

(75) Inventors: Roy A. Jacuzzi, Orinda; Garo J. Paroonagian, Martinez, both of CA (US)

(73) Assignee: Jacuzzi Whirlpool Bath, a division of Jacuzzi, Inc., Walnut Creek, CA (US)

( * ) Notice: Subject to any disclaimer, the term of this patent is extended or adjusted under 35 U.S.C. 154(b) by 0 days.

(21) Appl. No.: 09/978,393

(22) Filed: Oct. 16, 2001

(51) Int. Cl.[7] ..... E04H 4/12

(52) U.S. Cl. ..... 4/507; 4/541.1; 210/169; 210/242.1; 405/96; 405/101

(58) Field of Search ..... 4/490, 507, 509, 4/512; 210/169, 242.1, 416.2; 405/96, 100, 101, 102

(56) References Cited

U.S. PATENT DOCUMENTS

| | | | | | |
|---|---|---|---|---|---|
| 2,826,307 | A | * | 3/1958 | Pace | 210/169 |
| 3,314,543 | A | * | 4/1967 | Nash | 210/169 |
| 4,608,167 | A | * | 8/1986 | Raubenheimer | 4/490 X |

* cited by examiner

*Primary Examiner*—Robert M. Fetsuga
(74) *Attorney, Agent, or Firm*—Thomas R. Lampe

(57) ABSTRACT

A spa weir includes a support member forming an opening between a spa body interior and a filter housing interior. Two or more spa doors are located at the opening to control the flow of water through the opening, the spa doors being pivotally connected to one another and one of the spa doors being pivotally connected to the support member.

11 Claims, 3 Drawing Sheets

SPA WEIR SYSTEM

TECHNICAL FIELD

This invention relates to spas and more particularly to weir apparatus incorporated in spas.

BACKGROUND OF THE INVENTION

It is well known to incorporate filters in spas which filter the water during recirculation thereof. Typically, the filters are incorporated in housings or compartments of the spas and it is also well known to provide weirs in association with the filter housings or compartments to control water flow. Weir gates can be fixed or they can be movable to compensate for changes in the height of the surface of water in the spa, such as may be caused by different numbers of people occupying the spa.

Conventional practice has been to employ a single weir door. Such arrangements can be relatively slow in responding to water height variations. Furthermore, such devices allow debris in the filter housing or chamber to return to the spa body interior after the spa is powered down.

DISCLOSURE OF INVENTION

The present invention relates to a spa weir system which provides for a quicker response to water height variations than is the case with conventional weir door systems. Furthermore, the present invention significantly reduces the amount of debris that can flow back into the spa body interior after the unit is powered down.

Incorporated in the present invention is a spa including a spa body having a spa body interior and an opening communicating with the spa body interior.

Weir means is connected to the spa body and located at the opening for controlling the flow of water through the opening. The weir means includes a first weir door and a second weir door.

A first connector pivotally connects the first weir door to the spa body and a second connector pivotally connects the second weir door to the first weir door.

The spa additionally includes a filter housing defining a filter housing interior. The opening provides communication between the spa body interior and the filter housing interior.

The first and second weir doors are buoyant and responsive to changes in water level in the spa body interior and the filter housing interior to move between a first orientation wherein the first and second weir doors are substantially vertically aligned in the opening and substantially close the opening and the second orientation wherein the first and second weir doors are angularly disposed relative to one another and are positioned in the filter housing interior.

Other features, advantages and objects of the present invention will become apparent with reference to the following description and accompanying drawings.

BEST MODE FOR CARRYING OUT THE INVENTION

Figure 2:
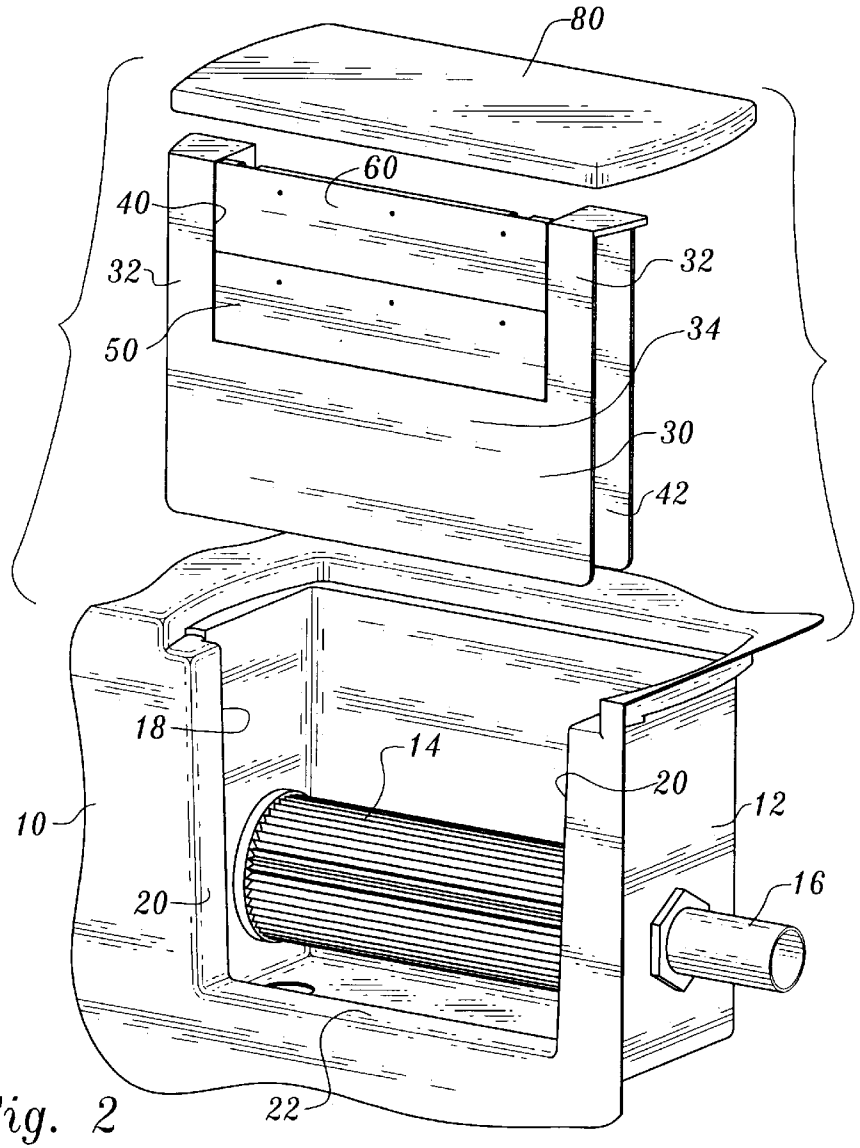
FIG. 2 is an exploded perspective view illustrating components of the weir prior to assembly thereof with the spa.
Figure 1:
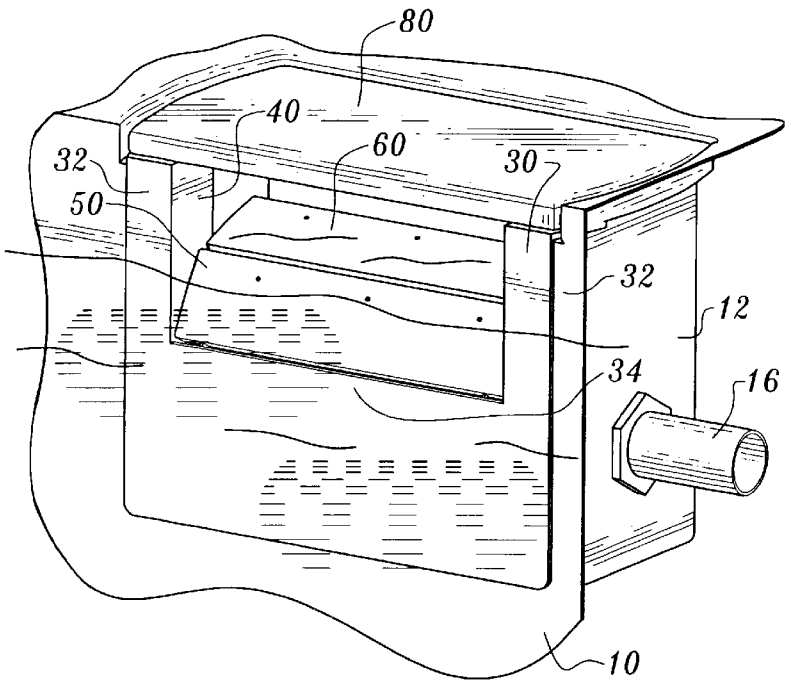
FIG. 1 is a perspective view illustrating a portion of a spa body and a filter housing body, weir means constructed in accordance with the teachings of the present invention being located at an opening between the spa body interior and the filter housing interior.
Figure 3:
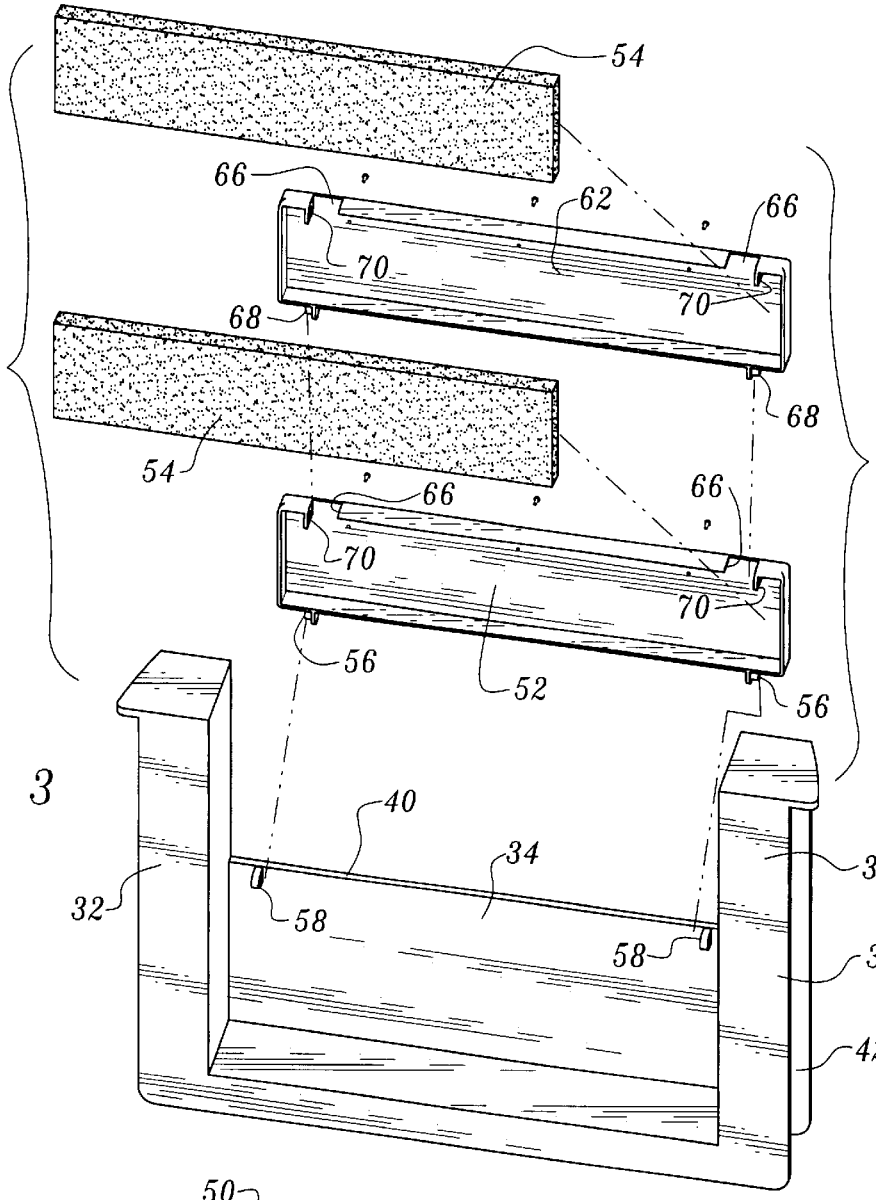
FIG. 3 is an exploded perspective view illustrating disassembled weir doors and a support member prior to interconnection.
Figure 4:
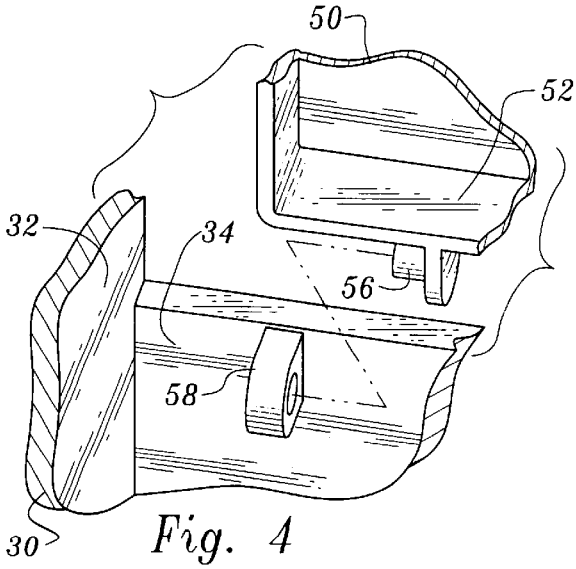
FIG. 4 is an enlarged view in partial cross-section illustrating details of the connector used to interconnect the support member and lowermost weir door.
Figure 5:
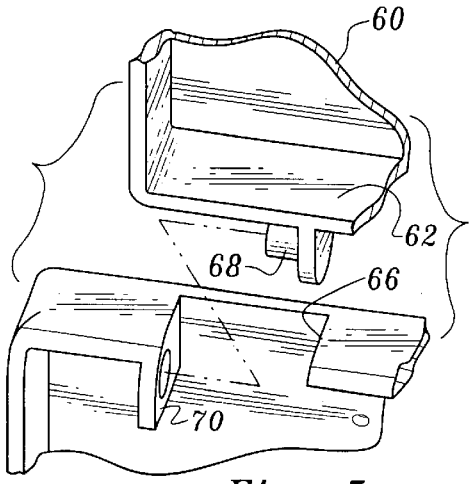
FIG. 5 is a view similar to FIG. 4 but illustrating details of the connector utilized to interconnect the two weir doors of the invention.

Referring now to the drawings, a spa includes a spa body 10 (only a portion of which is illustrated) defining a spa interior accommodating water. The spa also includes a filter housing 12 defining a filter housing interior accommodating a filter 14. As is conventional, the filter 14 is operatively associated with a recirculation pump (not shown) used to re-circulate the water of the spa. A portion of a conduit 16 employed to circulate the water and employed in association with the filter 14 is illustrated.

In the arrangement illustrated, the spa body and filter housing are of integral construction and a portion of the spa body wall forms a recess 18 at the location of the filter housing. The recess 18 is defined by wall elements 20 and ledge 22.

A support member 30 comprises a portion of the spa body, the support member having spaced vertical opening defining elements 32 and a horizontal opening defining element 34 which cooperate to define a rectangular shaped opening 40. Each of the vertical elements 32 forms a channel 42 open at the bottom thereof. Similarly, a channel 44 is formed at the bottom of element 34.

When the support member 30 is installed in position on the rest of the spa body, the channels 42 receive the wall elements 20 and channel 44 receives ledge 22 to maintain the support member in the recess 18. The support member may readily be removed from the recess when desired. Alternatively, the support member can be fixedly attached to the rest of the spa body or even integral therewith.

Pivotally connected to support member 30 is a weir door 50. Weir door 50 has a rectangular configuration and includes an outer weir door portion 52 formed of molded plastic or the like and an inner weir door portion 54 which is suitably formed of plastic foam material. The inner weir portion 54 is positioned within the confines of outer weir door portion 52 and secured thereto by any known expedient, such as screws or adhesive, so that weir door 50 is buoyant.

Projecting downwardly from outer weir door portion 52 are two pivot pins 56. These pivot pins 56 are positioned in sockets 58 projecting from element 34 of the support member 30. The weir door 50 is free to pivot relative to the support member in the direction of the interior of the filter housing.

The weir means of the present invention also includes a weir door 60 which is of the same construction as weir door 50, including outer weir door portion 62 and inner weir door portion 54 secured thereto.

It should be noted that notches 66 are formed at the tops of outer weir door portions 52, 62. Pivot pins 56, 68 project from the bottoms of the outer weir door portions 52, 62.

The weir doors 50, 60 are pivotally connected by a pivot interconnection between pivot pins 68 of weir door 60 and socket elements 70 of weir door 50, the notches 66 of weir door 50 accommodating the pivot pins. The weir door 60 is thus free to pivot relative to weir door 50 in the direction of the filter housing interior.

Figure 6:
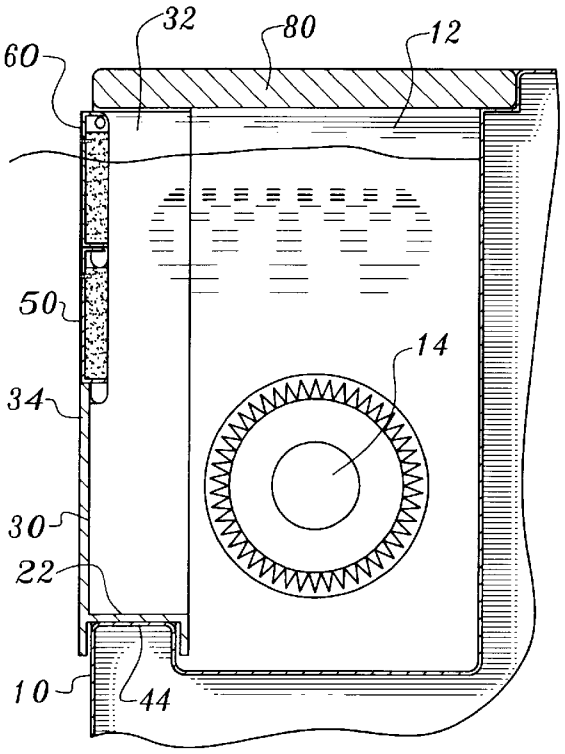

The first and second weir doors, as stated above, are buoyant. The weir doors are responsive to changes in the water level in the spa body interior and in the filter housing interior to move to and from a first orientation (shown in FIG. 6) wherein the first and second weir doors are in vertical alignment in the opening 40 and substantially close the opening, the ends of the weir doors being in close proximity to the vertical opening defining elements 32 of support member 30.

Figure 7:
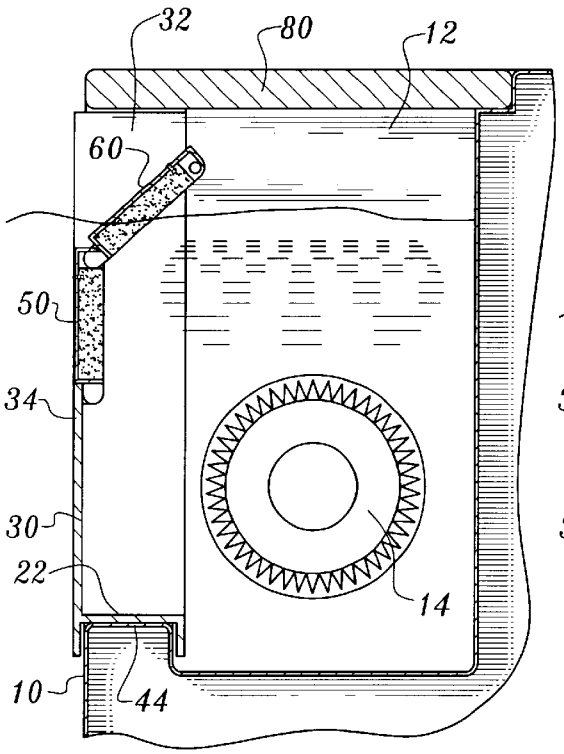

When the level of the water in the spa body interior (and the filter housing interior) drops, caused for example by one or more persons exiting the spa, the weir door 60 will pivot relative to weir door 50 into the filter housing interior as shown in FIG. 7.

Figure 8:
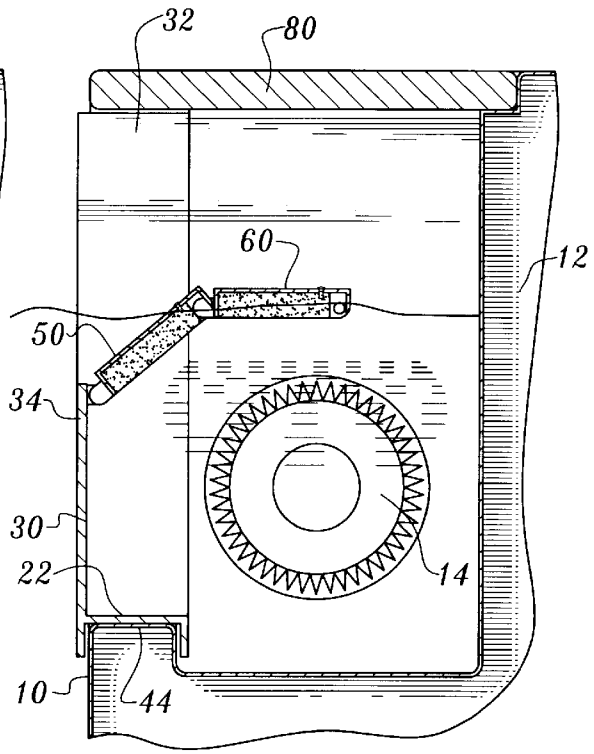
FIGS. 6–8 are cross-sectional views illustrating the articulated weir door of the present invention in different orientations resulting from different water levels in the spa with which it is associated.

A further drop in water level will cause the weir doors to assume an orientation wherein both doors are located in the filter housing interior (See FIG. 8).

It has been found that such an arrangement allows for quicker response to water height variations than is the case with a weir door system employing only one weir door. Furthermore, the two weir doors of the present invention significantly reduce the amount of debris that can flow back into the spa after the unit is powered down.

In the arrangement illustrated, a cover 80 is provided for positioning over the filter housing and opening 40.

It will be appreciated that changes can be made in the invention as disclosed without departing from the spirit or scope of the invention. For example, more than two weir doors may be employed. This adaptation is facilitated by the fact that the weir doors are of identical construction. Of course, this feature also allows lower manufacturing costs.

The invention claimed is:

1. In combination:

a spa including a spa body having a spa body interior and an opening communicating with said spa body interior; and weir means connected to said spa body and located at said opening for controlling the flow of water through said opening, said weir means including a first weir door, a second weir door, a first connector pivotally connecting said first weir door to said spa body and a second connector pivotally connecting said second weir door to said first weir door.

2. The combination according to claim 1 wherein said spa additionally includes a filter housing defining a filter housing interior, said opening providing communication between said spa body interior and said filter housing interior, said first and second weir doors being buoyant and responsive to changes in water level-in said spa body interior and said filter housing interior to move between a first orientation wherein said first and second weir doors are substantial vertically aligned in said opening and substantially close said opening and a second orientation wherein said first and second weir doors are angularly disposed relative to one another and positioned in said filter housing interior.

3. The combination according to claim 2 wherein said first and second weir doors are of substantially identical configuration.

4. The combination according to claim 2 wherein each of said first and second weir doors has a rectangular configuration.

5. The combination according to claim 2 additionally comprising a filter in said filter housing, said second weir door being positioned over said filter when said first and second weir doors are in said second orientation.

6. The combination according to claim 2 additionally comprising a cover for positioning over said filter housing and said opening.

7. The combination according to claim 1 wherein said second connector includes a pin and socket interconnection between said first weir door and said second weir door.

8. The combination according to claim 1 wherein said spa body includes a support member releasably attached to the remainder of said spa body, said support member defining said opening.

9. The combination according to claim 8 wherein said first connector comprises a pin and socket interconnection between said support member and said first weir door.

10. The combination according to claim 8 wherein each of said first and second weir doors has weir door ends and wherein said support member has spaced vertical opening defining elements in close proximity to said weir door ends when said first and second weir doors are in substantial vertical alignment.

11. In combination:

a spa including a spa body having a spa body interior and a filter housing connected to said spa body, said filter housing having a filter housing interior, said spa body defining an opening providing communication between said spa body interior and said filter housing interior; and a set of pivotally connected weir doors pivotally attached to said spa at said opening and responsive to changes in water level in said spa body interior and said filter housing interior to move between a first orientation wherein said weir doors substantially close said opening and a second orientation wherein said weir doors extend from said opening into said filter housing interior.

* * * * *